United States Patent [19]

Wagner et al.

[11] Patent Number: 4,557,131

[45] Date of Patent: Dec. 10, 1985

[54] DEVICE FOR INDIRECT EXTRUSION OF A HOLLOW SECTION

[75] Inventors: Alfred Wagner, Steisslingen; Adolf Ames, Duchtlingen, both of Fed. Rep. of Germany

[73] Assignee: Swiss Aluminium Ltd., Chippis, Switzerland

[21] Appl. No.: 563,309

[22] Filed: Dec. 20, 1983

[30] Foreign Application Priority Data

Dec. 24, 1982 [DE] Fed. Rep. of Germany ... 8236460[U]

[51] Int. Cl.[4] ..... B21C 25/00; B21C 26/00

[52] U.S. Cl. ..... 72/273; 72/273.5

[58] Field of Search ..... 72/263–265, 72/272, 273.5, 478, 482, 273, 253.1, 260, 266

[56] References Cited

U.S. PATENT DOCUMENTS

| | | | |
|---|---|---|---|
| 362,623 | 5/1887 | Heiss | 72/260 |
| 2,278,293 | 3/1942 | Watson | 72/478 |
| 2,371,041 | 3/1945 | Flowers | 72/478 |
| 2,860,775 | 11/1958 | Brauchler | 72/272 |
| 2,893,553 | 7/1959 | Kreidler | 72/266 |
| 3,150,773 | 9/1964 | Richter | 72/273.5 |
| 3,355,927 | 12/1967 | Sibler | 72/261 |
| 3,695,081 | 10/1972 | Gartner | 72/254 |
| 4,052,877 | 10/1977 | Zilges et al. | 72/273.5 |
| 4,084,422 | 4/1978 | Zilges et al. | 72/273.5 |
| 4,332,156 | 6/1982 | Broodman | 72/264 |

FOREIGN PATENT DOCUMENTS

| | | | |
|---|---|---|---|
| 68524 | 6/1981 | Japan | 72/266 |

*Primary Examiner*—Lowell A. Larson
*Attorney, Agent, or Firm*—Bachman & LaPointe

[57] ABSTRACT

A device for indirect extrusion of a hollow section from a billet, in particular a hollow aluminum billet, which is presented to a shape-giving orifice of a die, which is such that a container can be passed over it, thus enclosing the die, and features in its orifice a mandrel that determines the inner contour of the hollow section. A shaping recess is provided, with respect to the extrusion direction x, immediately in front of the shape-giving orifice of the die, the radial dimension of which recess is greater than the width of the shape-giving orifice. The shaping recess is provided either in the face of the die directed towards the extrusion stem or in the face of the extrusion stem directed towards face of the die.

5 Claims, 3 Drawing Figures

DEVICE FOR INDIRECT EXTRUSION OF A HOLLOW SECTION

BACKGROUND OF THE INVENTION

The invention relates to a device for indirect extrusion of a hollow section from a billet, in particular a hollow aluminum billet which is presented to a shape-giving opening of a die by an extrusion stem, the die being such that a billet container can be moved over it, thus enclosing it, and a mandrel which determines the inner contour of the hollow section is provided in the shape-giving opening of the die.

When hot forming a billet, pre-heated to the extrusion temperature, to strands or rods, the billet which is enclosed in the container is usually pressed by the extrusion stem of a hydraulic extrusion press into the stationary shaping die; the stem or a so-called dummy block on the extrusion stem forms the backing for the material which is to be extruded.

When extruding by the so-called indirect extrusion method, either the shaping tool, the die, is pushed into the stationary container or the latter is moveable and can be pushed over the die thus enclosing it. In both cases, prior to extrusion, a new billet is placed in the container next to the backing and compressed to fill the space around it in the container.

The die is mounted on a long tool stem which is subjected to high thermal and mechanical stresses; this tool stem must be hollow as the strand formed has to pass through it. By supporting the die the whole of the extrusion force acts on the tool stem during the extrusion stroke, this usually includes, besides the purely compressive forces, also torsional and bending forces. Furthermore, the mandrel projects into the tool stem.

Applications exist for hollow sections in the form of seamless, hollow tubes featuring flanges at the end joined to the tube body with as little change in structure as possible. Such an application, for example, is to be found in containers used in uranium precipitation plants; these containers usually comprise a hollow tube body with a flange welded onto and machined at one end.

SUMMARY OF THE INVENTION

In view of the above the object of the present invention is to manufacture in one piece and as inexpensively as possible, via indirect extrusion, a hollow section with integral flange, and to develop a device for this purpose.

This object is achieved by way of the invention in that a shaping recess is provided, with respect to the direction of extrusion, immediately before the shape-giving opening in the die, said recess having its radial dimension greater than the width of the die opening and being that place where the extruded matrix forms the flange that projects out beyond the side of the hollow section.

BRIEF DESCRIPTION OF THE DRAWINGS

Further advantages, features and details of the invention are revealed in the following description of preferred exemplified embodiments and with the help of the drawings viz.

DETAILED DESCRIPTION

Figure 1:
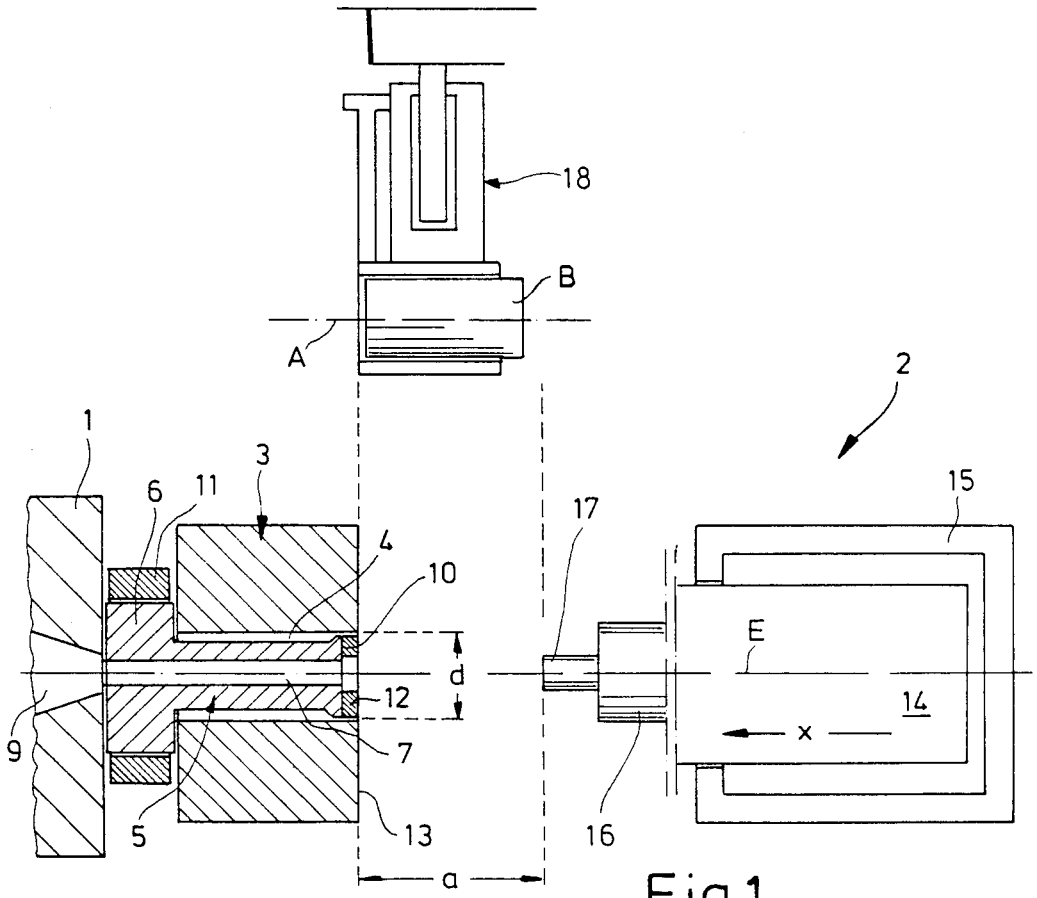
FIG. 1: A longitudinal section through a press for indirect extrusion of hollow sections.

It has been found particularly favorable to provide the shaping recess in the face of the die directed towards the extrusion stem so that the die shapes both the hollow section and the flange thereon in its full height. It is, however, also possible to provide for this shaping recess an extension recess running counter to the direction of extrusion, in the adjacent face of the extrusion stem; this is particularly useful if high-walled flanges are to be produced.

It is also within the scope of the invention only to provide the extrusion stem with a shaping recess which is penetrated by the mandrel; according to another feature of the invention this shaping recess is formed by a ring-shaped collar and an insert.

The shaping recess is thus a mold box for the flange, which in plan view is round, oval or preferably quadratic.

When the flanged tube has been formed, the extrusion stem is drawn back and the said tube withdrawn from the tool stem.

If the tool stem is likewise divided along a plane in its longitudinal axis as is the die, then, after moving the container back, the resultant flanged tube can be removed sideways, which permits relatively long tube lengths to be produced.

As the contours of the shaping recess determine the shape of the flange, it is for example also possible to provide this with ring-shaped ribs or the like, if corresponding grooves are present in the floor of the shaping recess.

Thanks to the invention it is now possible to extrude aluminum flanged tubes, which, up to now, has not been possible in the simple manner described above.

Referring to the drawings, situated in front of the platen 1 of an extrusion press 2 for producing hollow sections is a container 3 for indirect extrusion arranged separate from the platen 1. The central bore 4 in line with the main axis E of the press 2 allows the container 3 to be passed over a fixed, stationary tool stem 5, the head 6 of which is securely and directly mounted on the platen 1.

Running through the tool stem 5 is a central stem channel 7 which extends from a shape-giving die 10, not shown in detail in FIG. 1, to an opening 9 in the platen 1. The container 3 can be moved, counter to the direction of extrusion x, off the tool stem 5 held by slide 11.

Facing the die front 12 and the face 13 of the container 3 remote from platen 1 is a pressure cylinder 14 in stand 15; an extrusion stem or ram 16, and from this a mandrel 17, projects out from the cylinder 14 in the axis E of the press.

The distance a between face 13 of the container 3 facing cylinder 14 and the end of the mandrel 17 in the non-operating position shown in FIG. 1 is such that, in this position, a light metal billet B can be placed in front of tool stem 5 by means of a billet loader 18; when the axis or billet B lies coaxial to the press axis E, the billet B can be pressed by extrusion stem 16 in the direction of extrusion x.

Figure 2:
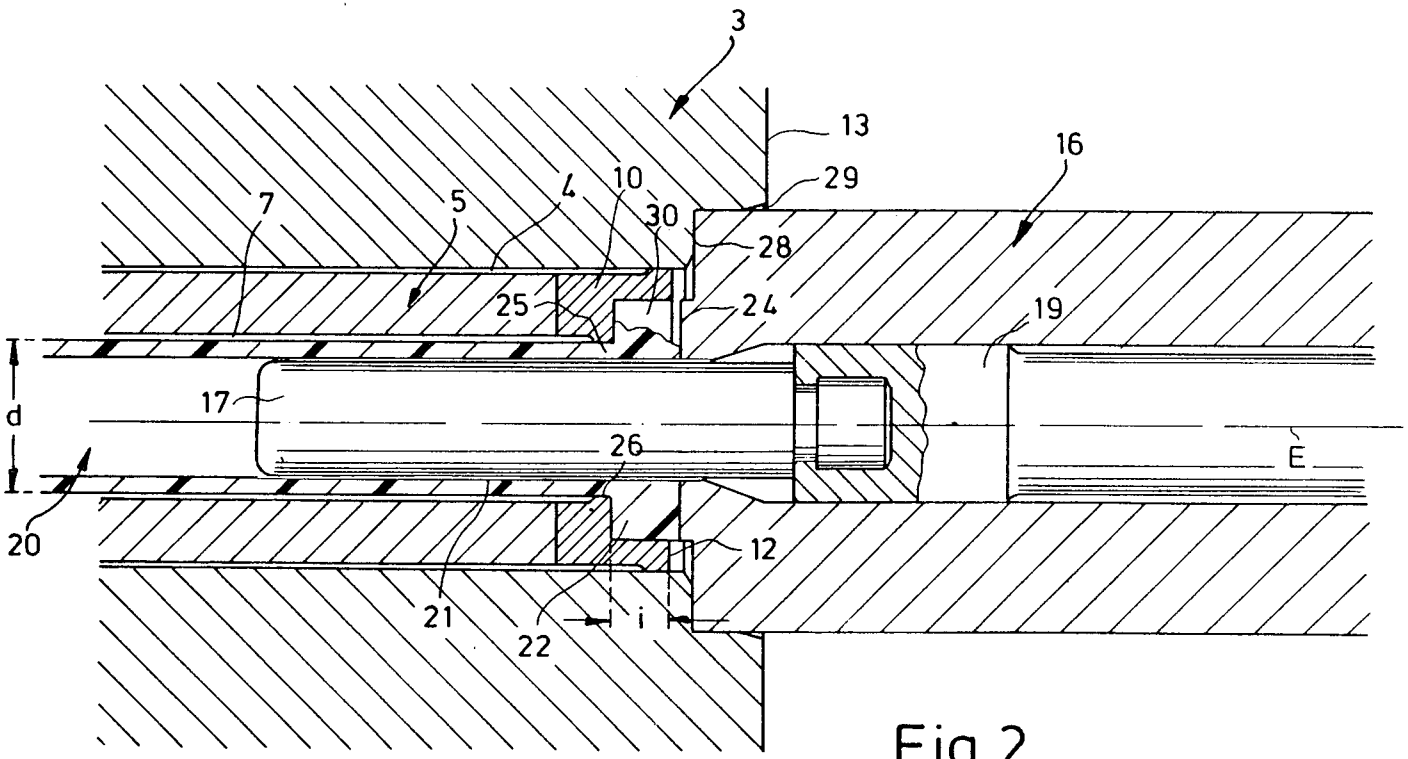
FIG. 2: An enlarged view of part of FIG. 1, showing a different operating position.

FIG. 2 indicates the production of a hollow section 20 having a hollow tube part 21 of outer diameter d and flange 22 of height i. Billet B is pressed by face 24 of extrusion stem 16 against die 10 which features a shaping orifice or opening 25. The ring-shaped wall 26 of the die 10 determines the outer contour of the tube part 21; the inner contour of the tube part 21 is determined by the mandrel 17 projecting into the orifice 25. Before the orifice, with respect to the extrusion direction x, is a shaping recess 30 in which the flange 22 resides at the end of the extrusion stroke. Face 24 of the extrusion stem 16 contacts face 12 of the die 10; a ring-shaped shoulder 28 on the extrusion stem 16 projects into a recess 29 in container 3.

In FIG. 2 it can be seen that the mandrel 17 is mounted in a mandrel channel 19 in extrusion stem 16.

Figure 3:
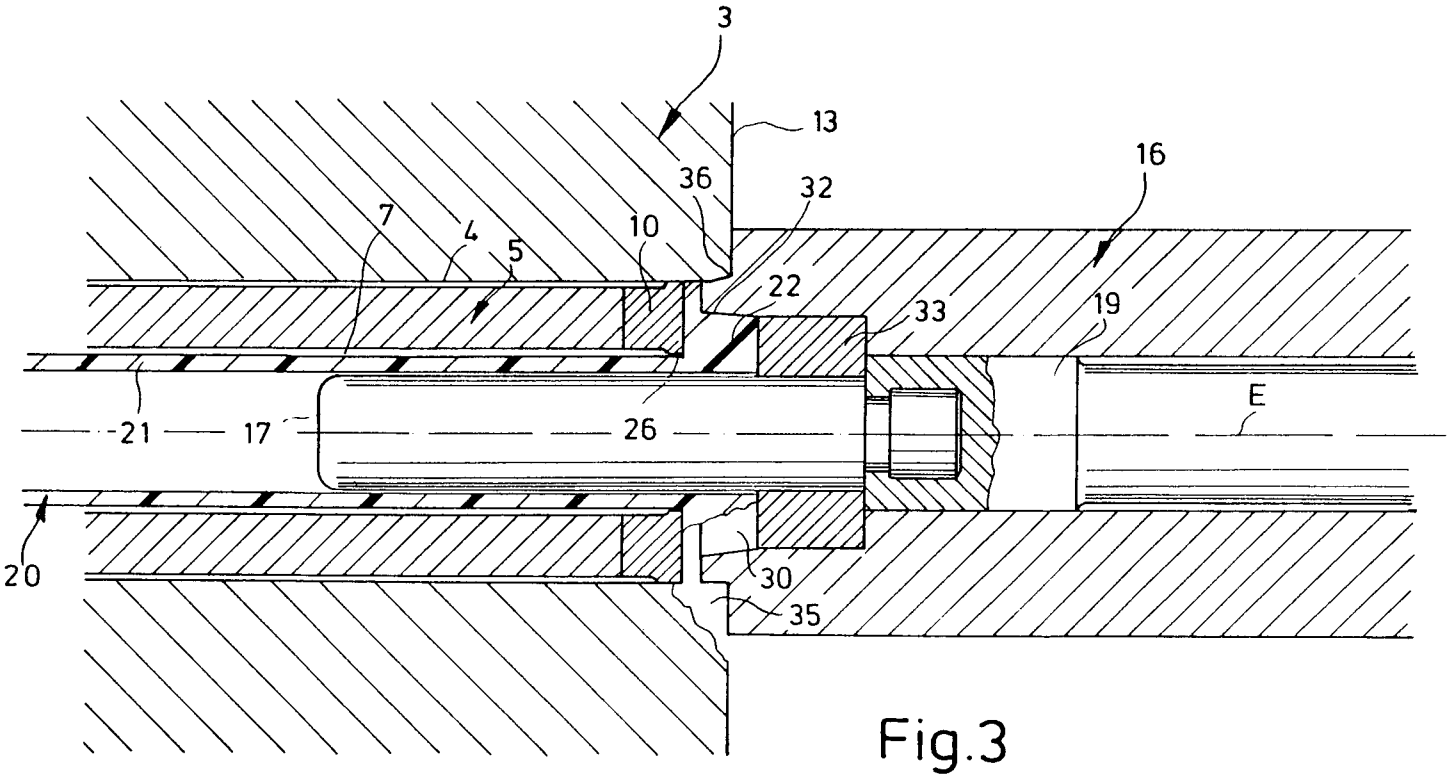
FIG. 3: Another exemplified embodiment, shown in the same operating position as in FIG. 2.

In the exemplified embodiment shown in FIG. 3 the shaping recess 30 is provided in the extrusion stem 16; it is made up of a ring-shaped projection 32 on the stem 16 and insert 33 mounted on the mandrel 17. Projecting ring 32 features a recess stop 35 which, in the shown end position, accommodates the ring-shaped edge 36 around the container bore 4.

As a result of the described device 2 it is now possible to extrude one-piece flanged pipes 20, which can be employed, for example, as centrifuge containers or receptacles for uranium separation plants. The shape of the flange 22, as seen in plan view, is determined by the shaping recess 30, and can be chosen at will, likewise the diameter d of flanged pipe 20. It can be decided according to the given conditions whether conventional hollow billets B are employed or whether these are heat-treated first. The facility for solution treatment of the billet B is not shown in the drawings.

What is claimed is:

1. Device for indirect extrusion of a hollow section having an extruded integral flange thereon that projects out beyond the side of the hollow section from a hollow billet which comprises: a die for extruding said billet, said die having a die face; a shape-giving orifice of said die which determines the outer contour of said section; a container movable with respect to said die enclosing the die; an extrusion ram and a single column-like mandrel projecting therefrom and operatively associated with said die and said orifice, said mandrel determines the inner contour of the hollow section and said extrusion ram having an extrusion ram face directed towards said die face; a shaping recess which determines the extruded integral flange provided immediately in front of said shape-giving orifice of the die with respect to the extrusion direction x, the radial dimension of said recess being greater than the width of the shape-giving orifice, wherein the recess is provided in the extrusion ram face running counter to the extrusion direction x and wherein the recess is formed by a ring-shaped collar and an insert defining the base of the recess and the shape of the flange.

2. Device according to claim 1 including grooves provided in the floor of the shaping recess.

3. Device according to claim 1 wherein the container and extrusion ram include mating stop-face elements which sealingly fit one into the other.

4. Device according to claim 1 including a tool stem downstream from said die, wherein the tool stem and die are divided radially and include means enabling the parts to be moved apart.

5. Device according to claim 1 wherein said shaping recess provided in said extrusion ram face is of quadratic cross-section.

* * * * *